US009689571B2

(12) United States Patent
Ryon et al.

(10) Patent No.: US 9,689,571 B2
(45) Date of Patent: Jun. 27, 2017

(54) OFFSET STEM FUEL DISTRIBUTOR

(71) Applicant: Delavan Inc., Des Moines, IA (US)

(72) Inventors: Jason Ryon, Carlisle, IA (US); Philip Buelow, West Des Moines, IA (US)

(73) Assignee: DELAVAN INC., Des Moines, IA (US)

( * ) Notice: Subject to any disclaimer, the term of this patent is extended or adjusted under 35 U.S.C. 154(b) by 76 days.

(21) Appl. No.: 14/158,348

(22) Filed: Jan. 17, 2014

(65) Prior Publication Data

US 2015/0198095 A1 Jul. 16, 2015

Related U.S. Application Data

(60) Provisional application No. 61/927,659, filed on Jan. 15, 2014.

(51) Int. Cl.
*F23R 3/28* (2006.01)
*F23R 3/14* (2006.01)
*F23D 11/10* (2006.01)

(52) U.S. Cl.
CPC ..... *F23R 3/28* (2013.01); *F23D 11/107* (2013.01); *F23R 3/14* (2013.01); *F23D 2900/11101* (2013.01)

(58) Field of Classification Search
CPC ... F23R 3/14; F23R 3/286; F23D 2900/14021
See application file for complete search history.

(56) References Cited

U.S. PATENT DOCUMENTS 5,067,655 A * 11/1991 Farago ..... B05B 1/3478 239/124
5,274,993 A * 1/1994 Keller ..... F23C 7/002 60/39.37
5,307,634 A * 5/1994 Hu ..... B01F 5/0451 60/737
5,699,667 A * 12/1997 Joos ..... F23C 7/002 60/737
6,622,488 B2 9/2003 Mansour et al.
7,174,717 B2 * 2/2007 Prociw ..... F23D 11/105 60/740
7,926,282 B2 4/2011 Chew et al.
8,096,135 B2 1/2012 Caples
2009/0249789 A1 * 10/2009 Zuo ..... F23R 3/286 60/746
2012/0228405 A1 9/2012 Buelow et al.

* cited by examiner

*Primary Examiner* — Stefan Ibroni
(74) *Attorney, Agent, or Firm* — Cantor Colburn LLP

(57) ABSTRACT

A nozzle is provided including a fuel swirler having an outer wall, an interior wall, and a fuel flow path configured to receive a fuel flow. The fuel flow path extends from adjacent and inlet end of the nozzle to a discharge end of the nozzle and is arranged between the outer wall and the interior wall. The fuel flow path includes a first inlet portion and a volute. The first inlet portion is generally offset from a center of the fuel swirler.

11 Claims, 5 Drawing Sheets

OFFSET STEM FUEL DISTRIBUTOR

CROSS-REFERENCE TO RELATED APPLICATIONS

This application claims the benefit of U.S. provisional patent application Ser. No. 61/927,659 filed Jan. 15, 2014, the entire contents of which are incorporated herein by reference.

BACKGROUND OF THE INVENTION

This invention generally relates to injectors and fuel nozzles for high temperature applications, and more particularly, to fuel injectors and nozzles for gas turbine engines.

In gas turbine engines, fuel injectors are typically used to inject fuel in a spray or atomized form into a combustion chamber of the engine. The atomized air/fuel mixture is then combusted to create the energy required to sustain engine operations. Prefilming air-blast fuel injector nozzles for issuing atomized fuel into the combustor of a gas turbine engine are well known in the art. In this type of nozzle, fuel is spread out into a thin continuous sheet and then subjected to the atomizing action of high-speed air. More particularly, atomizing air flows through concentric air swirl passages that generate two separate swirling airflows at the nozzle exit. At the same time, fuel flows through a plurality of circumferentially disposed ports which are oriented in an axial, radial, tangential or a combination of these directions and then onto a prefilming surface where it spreads out into a thin sheet before exiting the edge of the prefilming surface and interacting with the adjacent air streams.

Conventional fuel nozzles generally include a plurality of small slots or openings through which fuel flows. As a result of the small size of these openings, such nozzles are difficult to manufacture and therefore costly. In addition, these small openings are prone to blockages or plugging as a result of coking of the fuel passing there through.

BRIEF DESCRIPTION OF THE INVENTION

According to one embodiment of the invention, a nozzle is provided including a fuel swirler having an outer wall, an interior wall, and a fuel flow path configured to receive a fuel flow. The fuel flow path extends from adjacent and inlet end to a discharge end and is arranged between the outer wall and the interior wall. The fuel flow path includes a first inlet portion and a volute. The first inlet portion is generally offset from a center of the fuel swirler.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
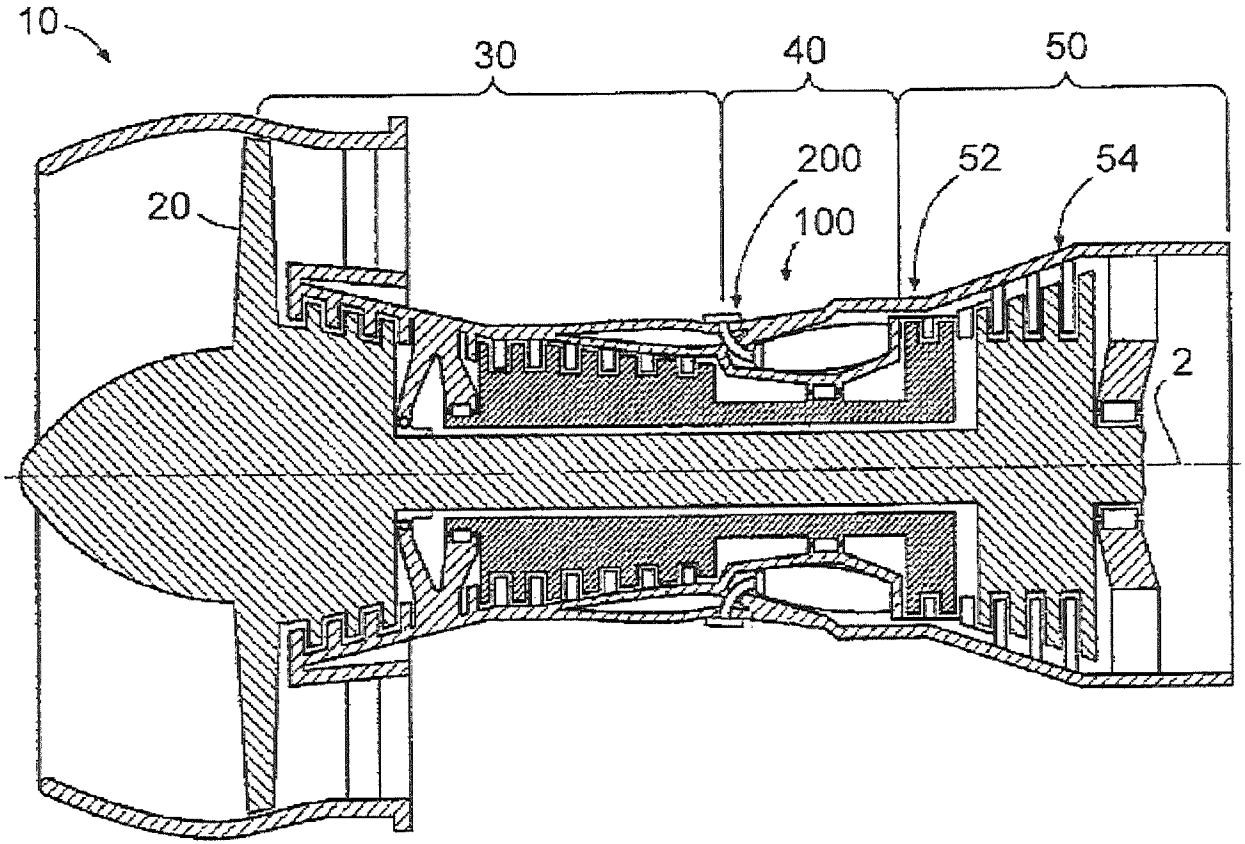
FIG. 1 is a schematic diagram of a gas turbine engine.

FIG. 1 is a schematic diagram of an embodiment of a gas turbine engine 10, such as used in an aircraft, for example. The illustrated gas turbine engine 10 incorporates a fan section 20, a compressor section 30, a combustion section 40, and a turbine section 50. The combustion section 40 incorporates a combustor 100 that includes an array of fuel injectors 200 that are positioned annularly about a centerline 2 of the engine 10 upstream of the turbine sections 52, 54. Throughout the application, the terms "forward" or "upstream" are used to refer to directions and positions located axially closer toward a fuel/air intake side of a combustion system than directions and positions referenced as "aft" or "downstream." The fuel injectors 200 are inserted into and provide fuel to one or more combustion chambers for mixing and/or ignition. It is to be understood that the combustor 100 and fuel injector 200 as disclosed herein are not limited in application to the depicted embodiment of a gas turbine engine 10, but are applicable to other types of gas turbine engines, and may also be applicable in industrial applications, such as spray drying for example.

Figure 2:
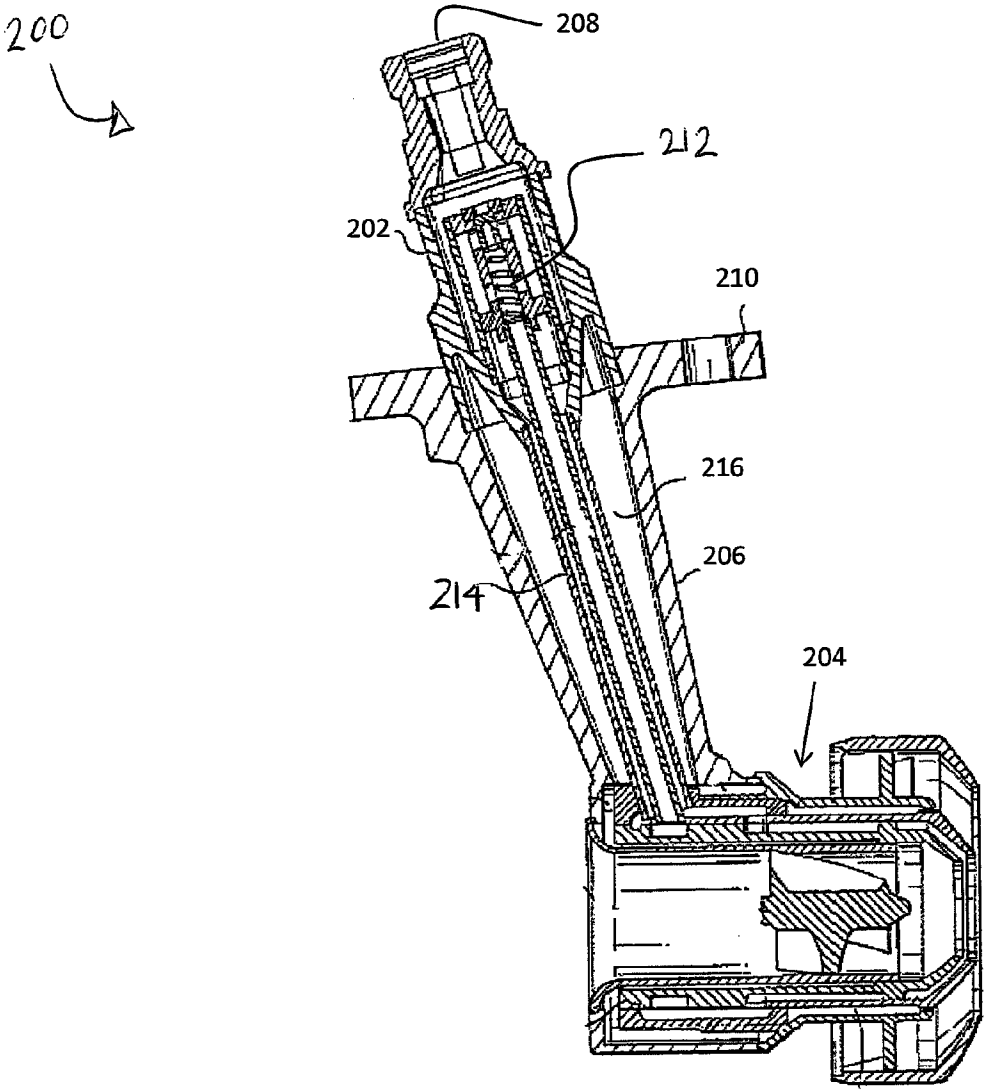
FIG. 2 is a cross-sectional view of a fuel injector according to an embodiment of the invention.

A fuel injector 200 configured for use in the gas turbine engine 10 is shown in more detail in FIG. 2. The fuel injector 200 includes a fuel inlet fitting 202 and a nozzle 204 connected to each other by a feed arm 206. Fuel inlet fitting 202 is provided at an upstream end 208 of the injector 200 for receiving fuel to be atomized for combustion and includes a mounting flange 210 configured to attach the injector 200 within a gas turbine engine 10. As illustrated, the fuel inlet fitting 202 may include a check valve 212 for distributing fuel from the inlet fitting 202 to a fuel conduit 214 extending through the feed arm 206 to the nozzle 204. In one embodiment, an insulation gap 216 is provided between the fuel conduit 214 and the outer wall of the feed arm 206 which may be filled with air, noble gases, a vacuum, or any other suitable form of insulation to insulate the fuel within the fuel conduit 214 from the high temperatures outside the feed arm 206.

Figure 3:
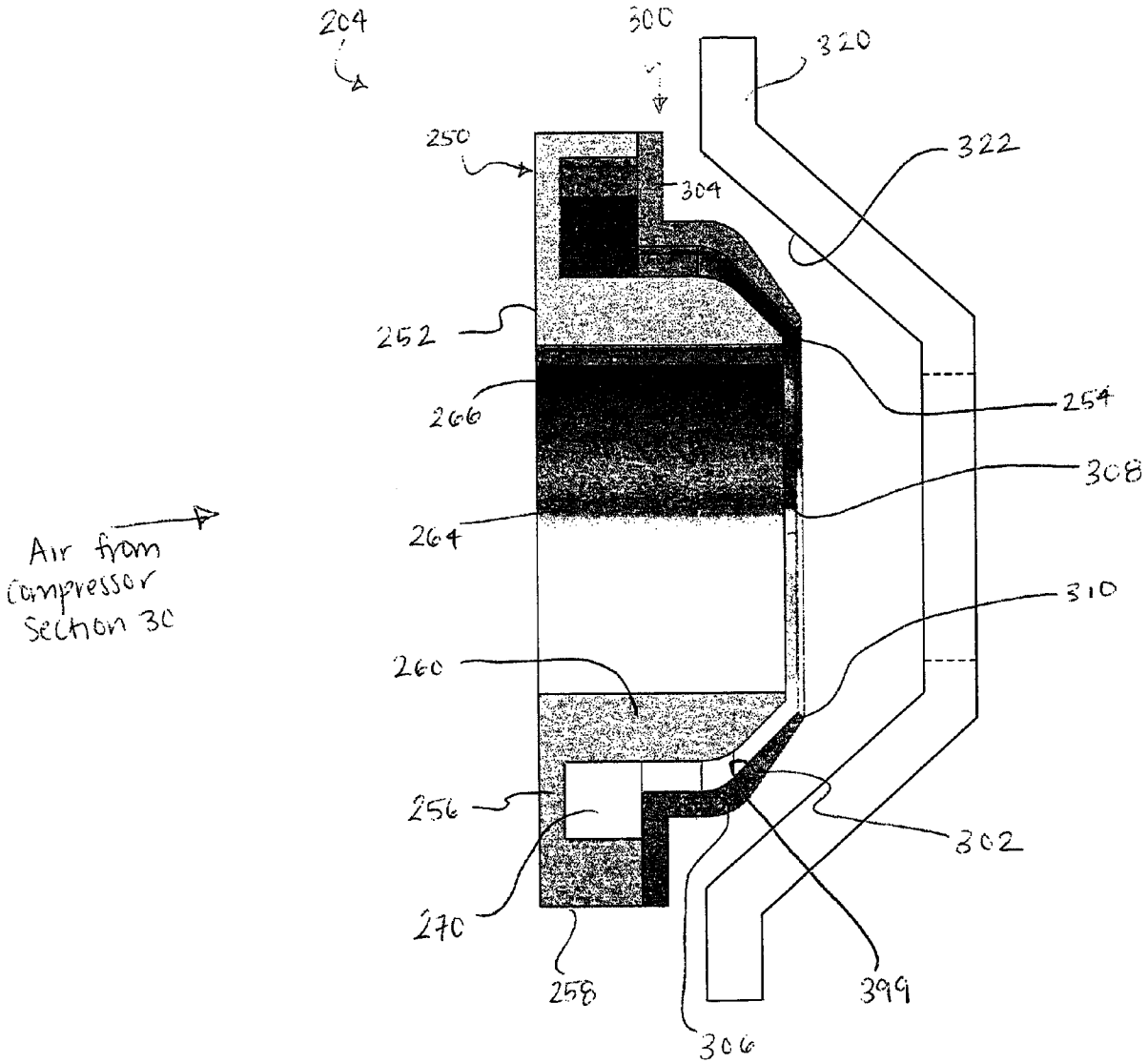
FIG. 3 is a cross-sectional view of a nozzle of a fuel injector according to an embodiment of the invention.

Referring now to FIG. 3, the nozzle 204 of the fuel injector 200 is provided in more detail. The nozzle 204 includes a plurality of components generally secured to one another, such as with welding or brazing for example. The nozzle 204 includes a fuel swirler 250 and a prefilming member 300, coupled together to form a fuel flow path for fuel provided to the nozzle 204 via fuel conduit 214. The nozzle 204 may additionally include an outer air cap or shroud 320 arranged generally downstream from the prefilming member 300. In one embodiment, at least a portion of the prefilming member 300 is surrounded by the outer shroud 320 such that an air flow path is formed between an exterior 302 of the prefilming member 300 and an interior surface 322 of the outer shroud 320.

The fuel swirler 250 of the nozzle 204 has a generally cylindrical body 256 including a radial outer wall 258 and a radial inner wall 260 bounded at an upstream end 252 by an axial wall 262. In one embodiment, the portion of the radial inner wall 260 adjacent a downstream end 254 of the fuel swirler 250 is angled radially inwardly. A central axial bore 264 extends through the radial inner wall 260 such that the bore 264 and an adjacent interior surface 266 define an air flow passage for air provided from the compressor section 30 of the engine 10. A volute 270 configured to receive a flow of fuel is formed between the radial outer wall 258 and the radial inner wall 260, adjacent the axial wall 262. At least one inlet 272 (see FIG. 4) fluidly connected to the volute 270 is configured to supply fuel from the fuel conduit 214 in the feed arm 206 to the fuel swirler 250.

The prefilming member 300 also includes an axial wall 304 and a radial wall 306 having a bore 308 extending through a downstream end 310 thereof. The axial wall 304 is oriented generally parallel to axial wall 262 and the radial wall 306 has a contour generally complementary to the radial inner wall 260 of the fuel swirler 250. For example, the downstream end 310 of the radial wall 306 may be angled generally inwardly at an angle similar to or different from the angle of the radial inner wall 260. The prefilming member 300 may be coupled to or integrally formed with a portion of the fuel swirler 250, such as the radial outer wall 258 for example. When the prefilming member 300 is connected to the radial outer wall 258 of the fuel swirler, the axial wall 304 is separated from the axial wall 262 by a distance and the radial wall 306 is separated from the radial inner wall 260 by a distance. As a result, the fuel flow path formed by the volute 270 is bounded axially by axial walls 262, 304 and is bounded radially by radial inner wall 260 and radial wall 258.

The nozzle 204 of FIG. 3 is an air blast nozzle configured to direct a large airflow through the axial bore 264 of the fuel swirler 250 and through the adjacent opening 308 in the prefilmer 300. This airflow combined with the airflow in the annulus formed between the prefilmer 300 and the outer air cap 320 provides sufficient energy to entrain and atomize fuel that is delivered from the fuel flow path at the downstream end 254 of the fuel swirler 250 for ejection of the resulting mixture into the combustion chamber (not shown) of an engine 10.

Figure 4:
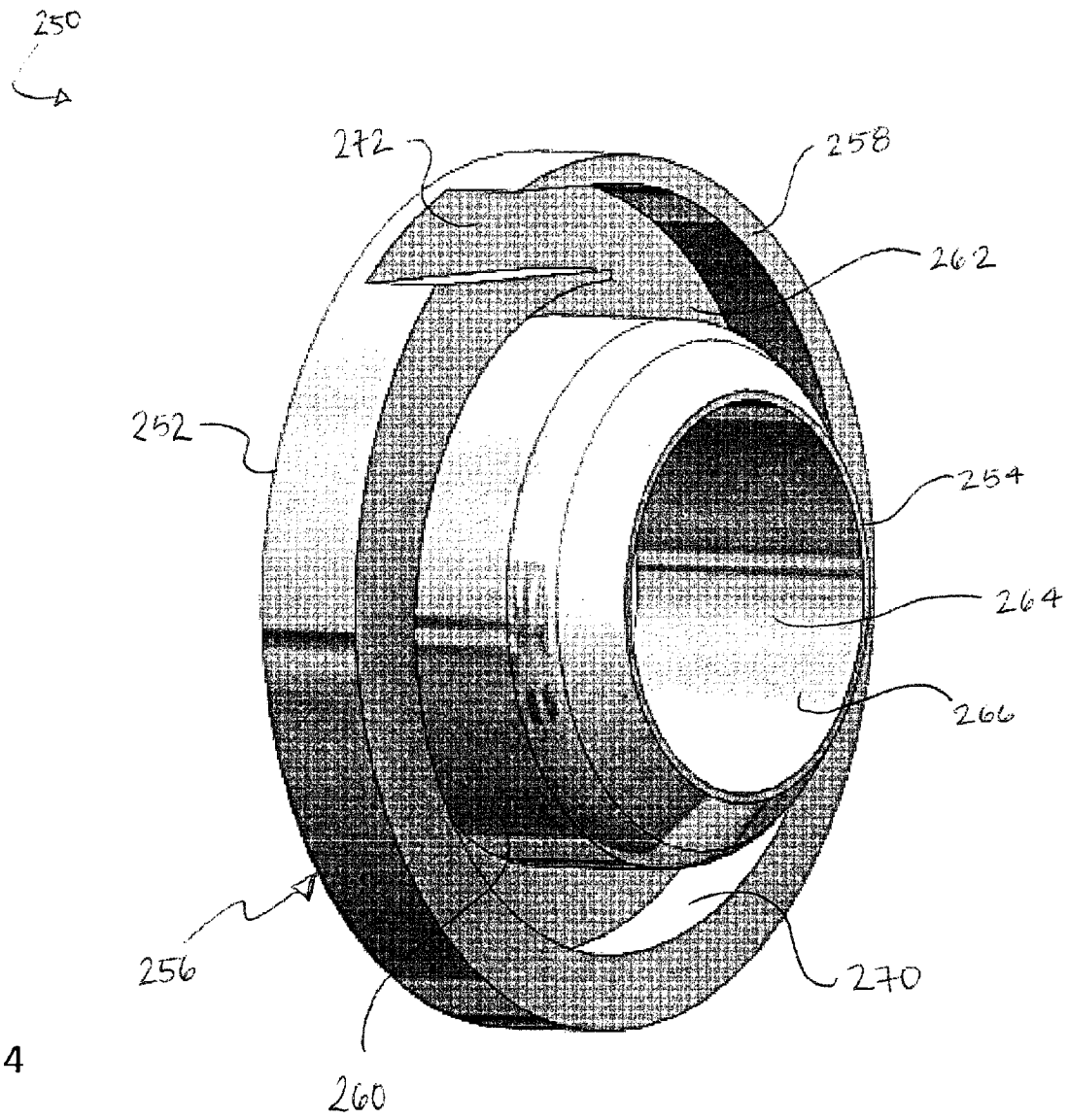
FIG. 4 is a perspective view of a fuel swirler of a nozzle according to an embodiment of the invention.
Figure 6:
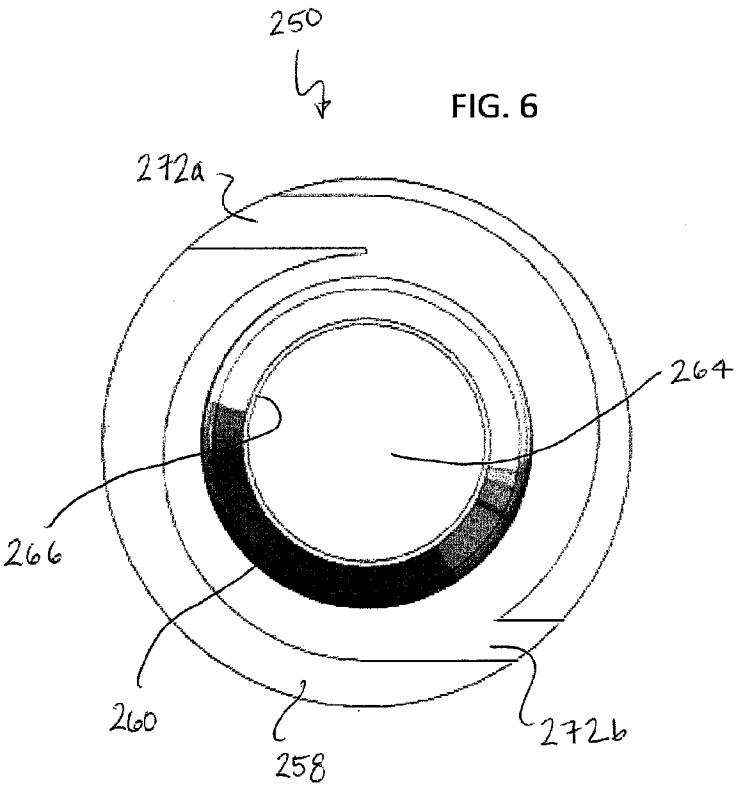
FIG. 6 is a front view of another fuel swirler according to an embodiment of the invention.
Figure 5:
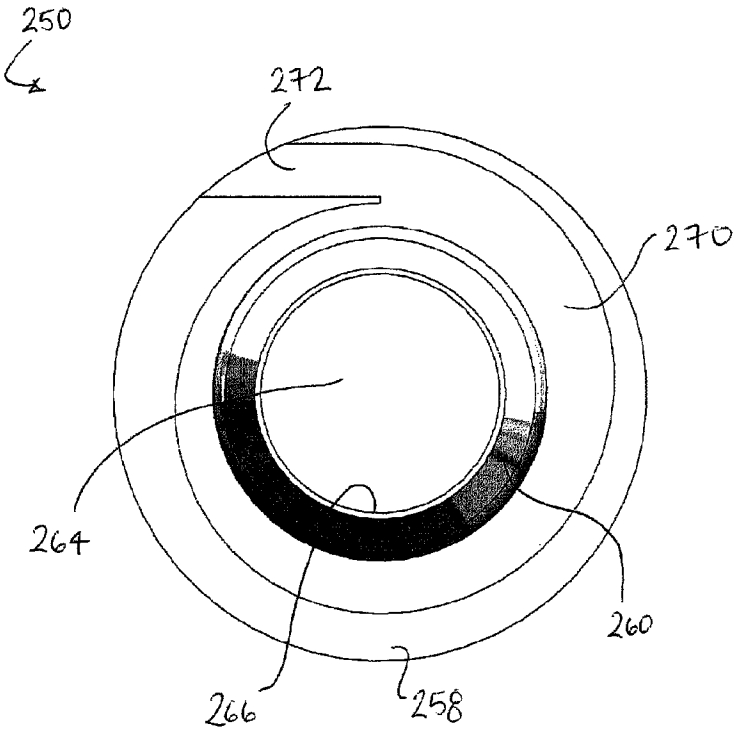
FIG. 5 is a front view of a fuel swirler according to an embodiment of the invention.

Referring now to FIGS. 4-6, the fuel flow path through the fuel swirler 250 formed by the inlet 272 and volute 270 is provided in more detail. As illustrated in FIG. 5, the inlet portion 272 is radially offset from the center of the fuel swirler 250, such as near the periphery for example, and is arranged substantially tangential to the volute 270. In embodiments where the volute 270 includes more than one inlet 272, such as a first inlet 272*a* and a second inlet 272*b* for example, the inlets 272*a*, 272*b* may be arranged diametrically opposite one another about the center of the fuel swirler 250 (FIG. 6).

The width of the volute 270, between the radial outer wall 258 and the radial interior wall 260, gradually decreases in the radial direction of the fuel flow to maintain the high velocity of the fuel and to evenly distribute the fuel at the downstream end 254 of the fuel swirler 250. In one embodiment, the width of the volute 270 decreases linearly as a function of the circumferential angle relative to the inlet portion 272. As the fuel flows through the volute 270, the fuel flows not only radially around the circumference of the radial inner wall 260, but also axially towards the downstream end 254 of the fuel swirler 250. As a result, the fuel flow bounded by the radial inner wall 260 of the fuel swirler 250 and the radial wall 306 of the prefilming member 300 forms a thin sheet of fuel on the inner surface 399 (see FIG. 3) of the radial wall 306.

A fuel injector 200 including nozzle 204 more uniformly distributes the fuel and improves the filming characteristics of the fuel. In addition, the overall length and weight of the nozzle 204 is significantly reduced. The simplified design reduces the manufacturing complexity, and therefore the cost of the nozzle 204, while improving the overall reliability.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A nozzle comprising:

a fuel swirler including:

an axial wall defining an inlet end, wherein the axial wall comprises a volute surface defining a volute;

a radial outer wall extending axially from a plane coincident with the volute surface of the axial wall and about a central bore toward a discharge end, wherein the radial outer wall comprises a radial outer wall volute surface defining the volute;

a radial inner wall extending axially from the plane coincident with the volute surface of the axial wall toward the discharge end and defining and circumferentially enclosing the central bore, wherein the radial inner wall comprises a radial inner wall volute surface defining the volute;

a fuel flow path configured to receive a fuel flow, the fuel flow path extending from adjacent the inlet end of the nozzle to the discharge end of the nozzle and being arranged between the radial outer wall and the radial inner wall, the fuel flow path includes a first inlet portion and the volute, the first inlet portion being generally offset from a center of the fuel swirler such that the first inlet portion is arranged at a tangent to the volute, the central bore extending from the inlet end to the discharge end, the central bore being configured to receive an airflow such that the fuel flow and the air flow mix adjacent a discharge end of the nozzle, the volute defined by the radial outer wall and the radial inner wall, a radial distance between the radial outer wall and the radial inner wall, for an entire circumferential arc segment of the outer wall volute surface, being continuously varied such that a width of the volute gradually decreases in a direction of the fuel flow, wherein the width is defined as the radial distance between the radial outer wall volute surface and the radial interior wall volute surface.

2. The nozzle according to claim 1, wherein the fuel flows through the fuel flow path in both a tangential and an axial direction.

3. The nozzle according to claim 1, wherein the width of the volute decreases linearly as a function of a circumferential angle relative to the inlet portion.

4. The nozzle according to claim 1, further comprising a second inlet portion being generally offset from a center of the fuel swirler and arranged substantially tangent to the radial outer wall volute surface.

5. The nozzle according to claim 4, wherein the second inlet portion is diametrically opposed from the first inlet portion about the center of the fuel swirler.

6. The nozzle according to claim 1, wherein the central axial bore is defined by an interior surface of the radial inner wall such that an air flow path is defined there through.

7. The nozzle according to claim 6, wherein a portion of the radial inner wall volute surface adjacent the discharge end is tapered radially inwardly.

8. The nozzle according to claim 7, further comprising a prefilmer mounted to the radial outer wall, the prefilmer including an opening arranged at a discharge end arranged coaxially with the central axial bore of the fuel swirler.

9. The nozzle according to claim 8, wherein the prefilmer encloses the fuel flow path.

10. The nozzle according to claim 8, wherein an interior surface of the prefilmer is generally complementary to the radial inner wall of the fuel swirler.

11. The nozzle according to claim 10, wherein the interior surface of the prefilmer tapers radially inwardly adjacent the discharge end thereof.

* * * * *